US010856673B2

(12) United States Patent
Rideout

(10) Patent No.: US 10,856,673 B2
(45) Date of Patent: Dec. 8, 2020

(54) STATIONARY WHEELCHAIR STORAGE APPARATUS

(71) Applicant: Claretta Rideout, Catonsville, MD (US)

(72) Inventor: Claretta Rideout, Catonsville, MD (US)

( * ) Notice: Subject to any disclaimer, the term of this patent is extended or adjusted under 35 U.S.C. 154(b) by 0 days.

(21) Appl. No.: 16/737,418

(22) Filed: Jan. 8, 2020

(65) Prior Publication Data

US 2020/0214476 A1 Jul. 9, 2020

Related U.S. Application Data

(60) Provisional application No. 62/789,588, filed on Jan. 8, 2019.

(51) Int. Cl.

| | |
|---|---|
| ***A47F 10/04*** | (2006.01) |
| ***A61G 5/10*** | (2006.01) |
| ***E04H 6/00*** | (2006.01) |

(52) U.S. Cl.

CPC ..... *A47F 10/04* (2013.01); *A61G 5/10* (2013.01); *E04H 6/005* (2013.01)

(58) Field of Classification Search

CPC ..... A47F 10/04; A61G 5/10; E04H 6/005
See application file for complete search history.

(56) References Cited

U.S. PATENT DOCUMENTS

| | | | | |
|---|---|---|---|---|
| 3,561,567 A * | 2/1971 | Bradley | ..... | A47F 10/04 186/52 |
| 3,978,959 A * | 9/1976 | Muellner | ..... | G07F 7/0636 194/211 |
| 4,027,747 A * | 6/1977 | Moorman, Jr. | ..... | A61G 3/0808 188/28 |
| 4,325,576 A * | 4/1982 | Guthrie | ..... | A61G 3/0808 280/250.1 |

(Continued)

FOREIGN PATENT DOCUMENTS

| | | | |
|---|---|---|---|
| CN | 205558356 U | * | 9/2016 |
| CN | 207587080 U | * | 7/2018 |

OTHER PUBLICATIONS

"Lifting Wheelchair Racks for High Capacity Wheelchair Storage Overhead", Southwest, Jul. 25, 2018, https://www.southwestsolutions.com/hospital-bed-storage-vertical-lifts/lifting-wheelchair-racks-high-capacity-wheelchair-storage-overhead.

(Continued)

*Primary Examiner* — Ko H Chan

(57) ABSTRACT

A stationary wheelchair storage apparatus includes a floor mounted enclosure, an entrance, at least one guard rail, and a wheelchair stopper. The floor mounted enclosure includes a base floor, a first wall, a second wall, and a third wall. The first wall, the second wall, and the third wall are perpendicularly mounted onto the base floor. The third wall is terminally positioned to the first wall and the second wall. The third wall is perpendicularly connected to the first wall and the second wall thus defining a specific storage area for (Continued)

wheelchairs. The entrance is delineated by the first wall and the second wall and provides an opening to enter the floor mounted enclosure. The at least one guard rail internally connected to the floor mounted enclosure to eliminate damages from the wheelchairs. The wheelchair stopper is integrated into the enclosure to secure the wheelchairs within.

11 Claims, 8 Drawing Sheets

(56) References Cited

U.S. PATENT DOCUMENTS 4,354,604 A * 10/1982 Isaacs ..... B62B 3/00 188/32
4,475,762 A * 10/1984 DeLong ..... A61G 3/0808 105/345
4,768,497 A * 9/1988 Winge ..... A61G 5/104 297/DIG. 4
5,133,375 A 7/1992 Schinzing
D376,854 S * 12/1996 DiPaolo ..... D25/15
6,090,218 A * 7/2000 Brackmann ..... A47F 10/04 134/123
7,044,446 B2 * 5/2006 Hempen ..... A47F 10/04 211/17
D765,560 S * 9/2016 Tahir ..... B25H 1/02 D12/133
2002/0110434 A1 * 8/2002 Ditch ..... A61G 3/0808 410/7
2018/0073268 A1 3/2018 Pescovitz

OTHER PUBLICATIONS

"Patterson Pope Wheelchair Storage", https://pattersonpope.com/products/lifts-and-carousels/wheelchair-storage/#1238112f-0f04-1.
"SpaceSaver Storage Solutions Wheelchair Lift", https://www.spacesaverva.com/products/healthcare-storage-solutions/concept-storage/.
"Wheelchair Storage Racks", Southwest, Aug. 30, 2018, https://www.southwestsolutions.com/wheelchair-storage-racks-space-saving-wall-mounted-overhead-lifts.

* cited by examiner

STATIONARY WHEELCHAIR STORAGE APPARATUS

The current application claims a priority to the U.S. Provisional Patent application Ser. No. 62/789,588 filed on Jan. 8, 2019.

FIELD OF THE INVENTION

The present invention relates generally to wheelchair storage apparatuses and the like. More specifically, the present invention is a stationary wheelchair storage area that utilizes a wheelchair stopper so that the wheelchairs do not roam freely.

BACKGROUND OF THE INVENTION

In present society, accessibility is a focus in designing public features that are commonly in need or accessed by all individuals. This means in trying to design public features, like countertops, storage areas, bathrooms, or doorways, with accessibility for individuals with disability in mind. This commonly involves in designing public features with people utilizing wheelchairs; such as widening the entryway to accommodate a person on a wheelchair. Many buildings often have reserved areas near most entryways that allow such individuals to locate a wheelchair for use. However, when not in use, wheelchairs can roam freely away from such areas causing obstructions in other areas like hallways and such or blocking individuals leaving/entering said building. Although there are storage units designed to store and house wheelchairs, these devices are convoluted, complicated to operate, require excessive energy/power to operate, and/or are required too much floor space to be installed.

An objective of the present invention is to provide users with a stationary wheelchair storage area. The present invention intends to provide users with a set up that can minimize the floor space required to install or utilize the stationary wheelchair storage area. The present invention also intends to provide users with a set up that utilize low electrical power to operate. The present invention also intends to provide users a set up that is easier to operate so that the users can easily engage with the storing and retrieving of wheelchairs.

DETAIL DESCRIPTIONS OF THE INVENTION

All illustrations of the drawings are for the purpose of describing selected versions of the present invention and are not intended to limit the scope of the present invention.

The present invention is a stationary wheelchair storage apparatus that can be any shape and/or size such that the present invention is able to secure and/or store multiple wheelchairs. Furthermore, the present invention provides a storage solution to freely placed wheelchairs within a building that cause obstructions in areas like hallways, reception areas, entrances, and waiting areas. For example, random placement of wheelchairs by entrance can block individuals leaving/entering a building thus resulting a hazardous conditions.

Figure 1:
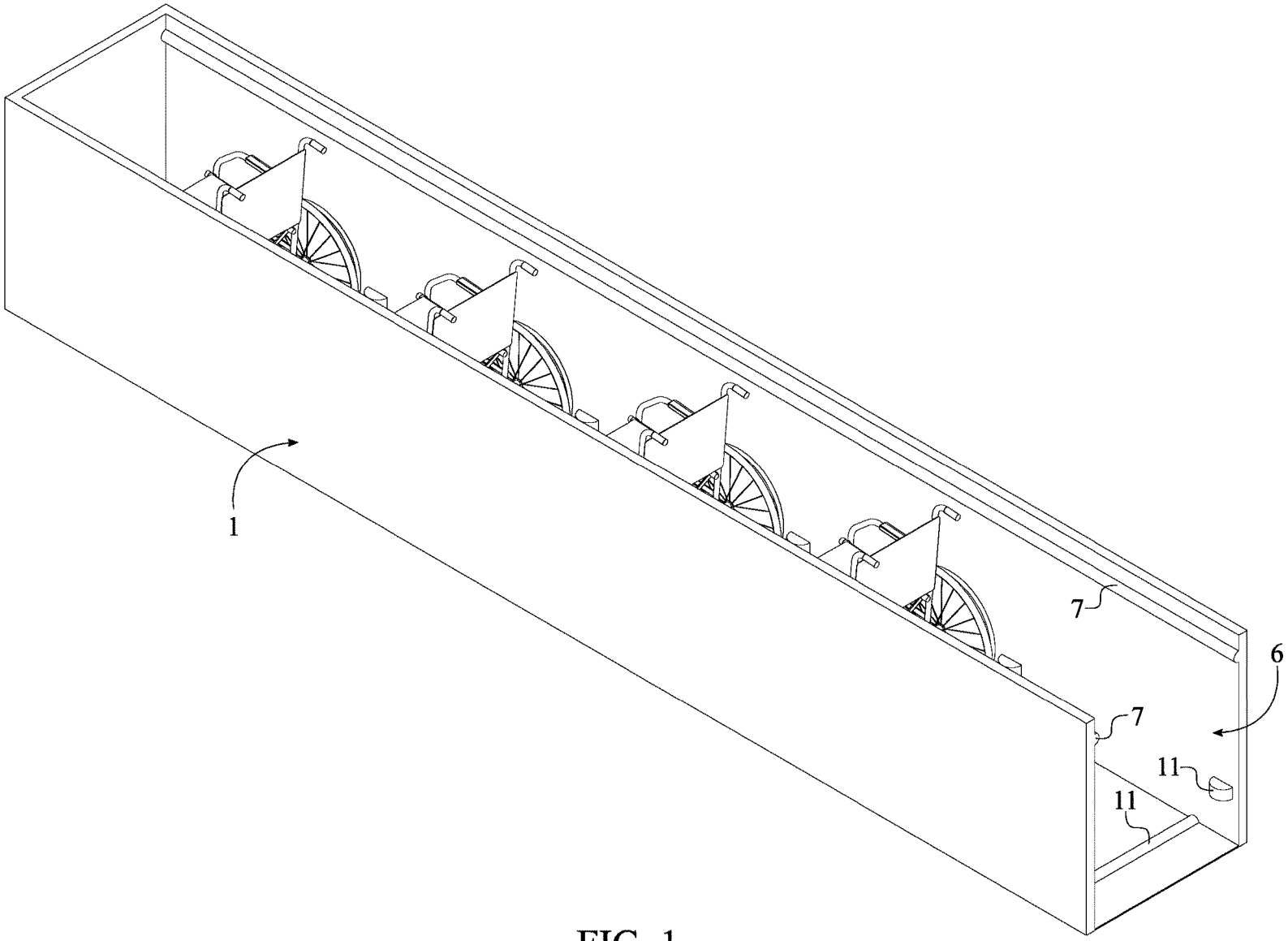
FIG. 1 is a top perspective view of the present invention, without the roof.
Figure 2:
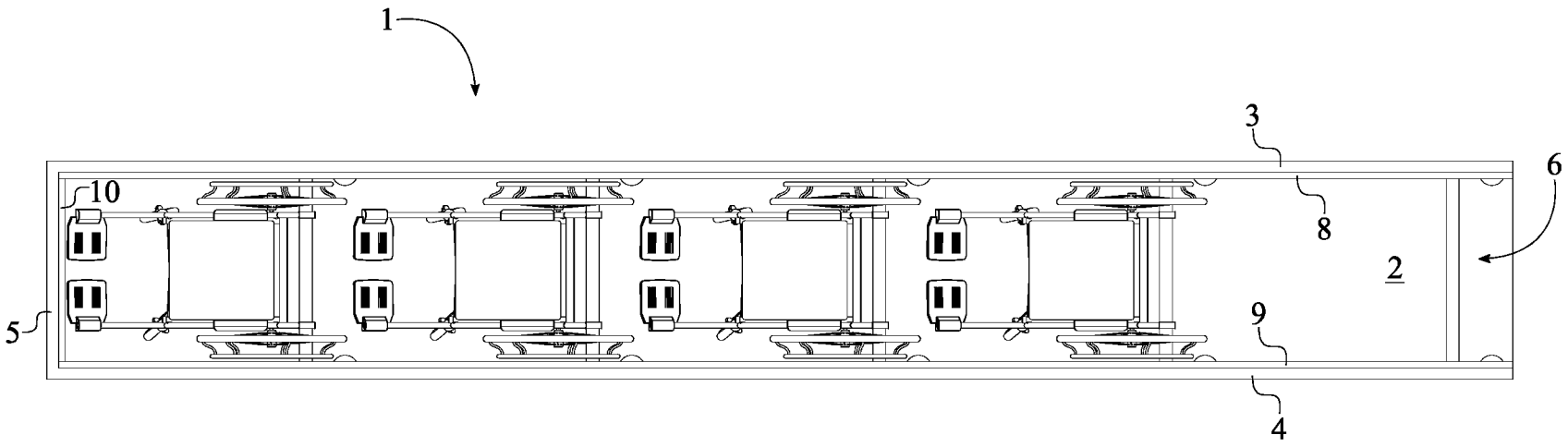
FIG. 2 is a top view of the present invention, without the roof.

The present invention comprises a floor mounted enclosure 1, an entrance 6, at least one guard rail 7, and a wheelchair stopper 11 as shown in FIG. 1. Furthermore, the floor mounted enclosure 1 that structurally outlines the preferred shape of the present invention comprises a base floor 2, a first wall 3, a second wall 4, and a third wall 5 as shown in FIG. 2. In reference to the general configuration of the present invention, the first wall 3, the second wall 4, and the third wall 5 are perpendicularly mounted onto the base floor 2 and vertically extended upward. The third wall 5 is terminally positioned to the first wall 3 and the second wall 4 and perpendicularly connected to the first wall 3 and the second wall 4. As a result, the first wall 3, the second wall 4, and the third wall 5 are able to define a U-shaped storage area for the wheelchairs. The entrance 6 is delineated by the first wall 3 and the second wall 4 so that the wheelchairs can be pushed into the floor mounted enclosure 1 through the entrance 6. The at least one guard rail 7 defines a lateral barrier between the floor mounted enclosure 1 and the wheelchairs so that an inside surface of the floor mounted enclosure 1 can be protected from accidental impacts of the wheelchairs. In order to accomplish this, the at least one guard rail 7 is internally connected to the floor mounted enclosure 1 and positioned offset of the base floor 2. The wheelchair stopper 11 is integrated into the enclosure 1 so that the unintentional rolling back of the wheelchairs can be eliminated within the present invention.

The base floor 2 is generally a flat surface area so that the wheelchairs can be easily pushed in or pulled out of the floor mounted enclosure 1. In reference to FIG. 1-2, the first wall 3, the second wall 4, and the third wall 5 function as the lateral parameters of the floor mounted enclosure 1. In some embodiments, the first wall 3, the second wall 4, and the third wall 5 can be short walls so that the users of the present invention can look into the floor mounted enclosure 1 over the short walls and the entrance 6. In some embodiments, the first wall 3, the second wall 4, and the third wall 5 can be full height walls that extends all the way up to the ceiling of a building. As a result, the users can only look into the floor mounted enclosure 1 through the entrance 6. In some embodiments, the first wall 3, the second wall 4, and the third wall 5 can be a combination of short walls and full height walls to accommodate the existing structural walls of a building. Depending upon the structural configuration of the building, the first wall 3, the second wall 4, and/or the third wall 5 can have decorative elements or design features to enhance the aesthetic appearance of the present invention.

Figure 3:
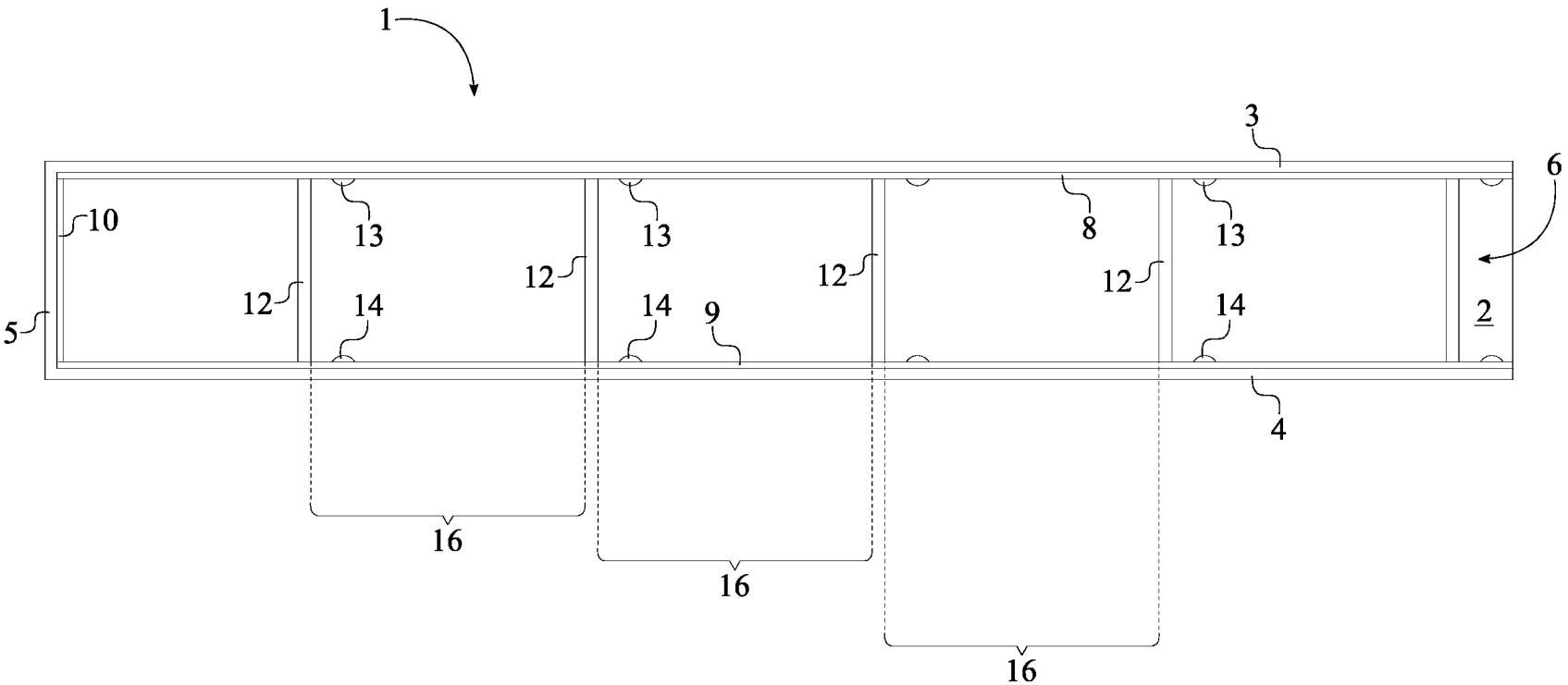
FIG. 3 is a top view of the present invention, without the roof and showing the distance between each of the plurality of cross bumpers.
Figure 5:
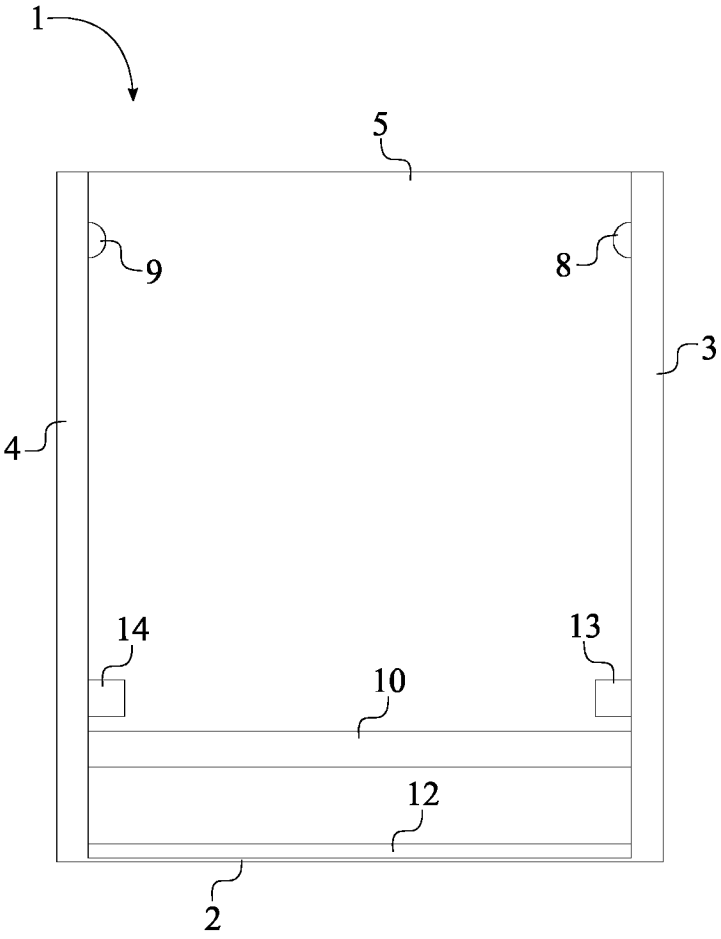
FIG. 5 is a side view of the present invention shown through the entrance, illustrating the height different between the first guard rail, the second guard rail, and the third guard rail.

In reference to FIG. 2-3 and FIG. 5, the at least one guard rail 7 is an elongated body and comprises a first guard rail 8 and a second guard rail 9. More specifically, the first guard rail 8 is connected along the first wall 3 and positioned offset of the base floor 2. The second guard rail 9 is connected along the second wall 4 and positioned offset of the base floor 2. In other words, the first guard rail 8 and the second guard rail 9 are extended from the third wall 5 to the entrance 6 along the first wall 3 and the second wall 4, respectively. The first guard rail 8 and the second guard rail 9 are connected above the base floor 2 at a specific height so that the wheelchairs are able to properly align within the floor mounted enclosure 1. The specific height of the first guard rail 8 and the second guard rail 9 is slightly lower than the overall height of the wheelchairs. Preferably, the specific height ranges from 20-38 inches so that the first guard rail 8 and the second guard rail 9 can position below the standard height of the wheelchairs. As a result, the first guard rail 8 and the second guard rail 9 is able to come into the contact with the rear wheels or handrims of the wheelchair thus respectively protecting the first wall 3 and the second wall 4 from the rear wheels or the handrims of the wheelchairs.

In reference to FIG. 2-3 and FIG. 5, the at least one guard rail 7 further comprises a third guard rail 10 that is structurally similar to the first guard rail 8 and the second guard rail 9. More specifically, the third guard rail 10 is connected along the third wall 5 and positioned offset of the base floor 2. In other words, the third guard rail 10 is extended from the first wall 3 to the second wall 4. Furthermore, a height of the third guard rail 10 is equal to a footrest height of the wheelchair. Preferably, the third guard rail 10 is connected at a height range of 4-10 inches above the base floor 2. As a result, the third guard rail 10 is able to come into the contact with the footrest of the wheelchair thus protecting the third wall 5 from the footrest of the wheelchairs.

In first embodiment of the present invention, the wheelchair stopper 11 is a plurality of cross bumpers 12 as shown in FIG. 1 and FIG. 3. More specifically, each of the plurality of cross bumpers 12 is preferably a half-cylindrical body and is equally distributed across the base floor 2. Furthermore, each of the plurality of cross bumpers 12 is perpendicularly positioned in between the first wall 3 and the second wall 4 and mounted to the base floor 2. As a result, each of the plurality of cross bumpers 12 is able to individually stop a single wheelchair from rolling back towards the entrance 6 as the rear wheels of the wheelchair comes into contact with one of the plurality of cross bumpers 12. A distance 16 between each of the plurality of cross bumpers 12 is preferably ranges from 30-48 inches so that the present invention is able to store different types of wheelchairs that vary in total length. For example, a first bumper of the plurality of cross bumpers 12 is positioned adjacent and parallel to the third wall 5 so that a wheelchair can be stored between the third wall 5 and the first bumper. The stored wheelchair is then able to remain within the third wall 5 and the first bumper as the rear wheels of the stored wheelchair comes into contact with the first bumper.

Figure 4:
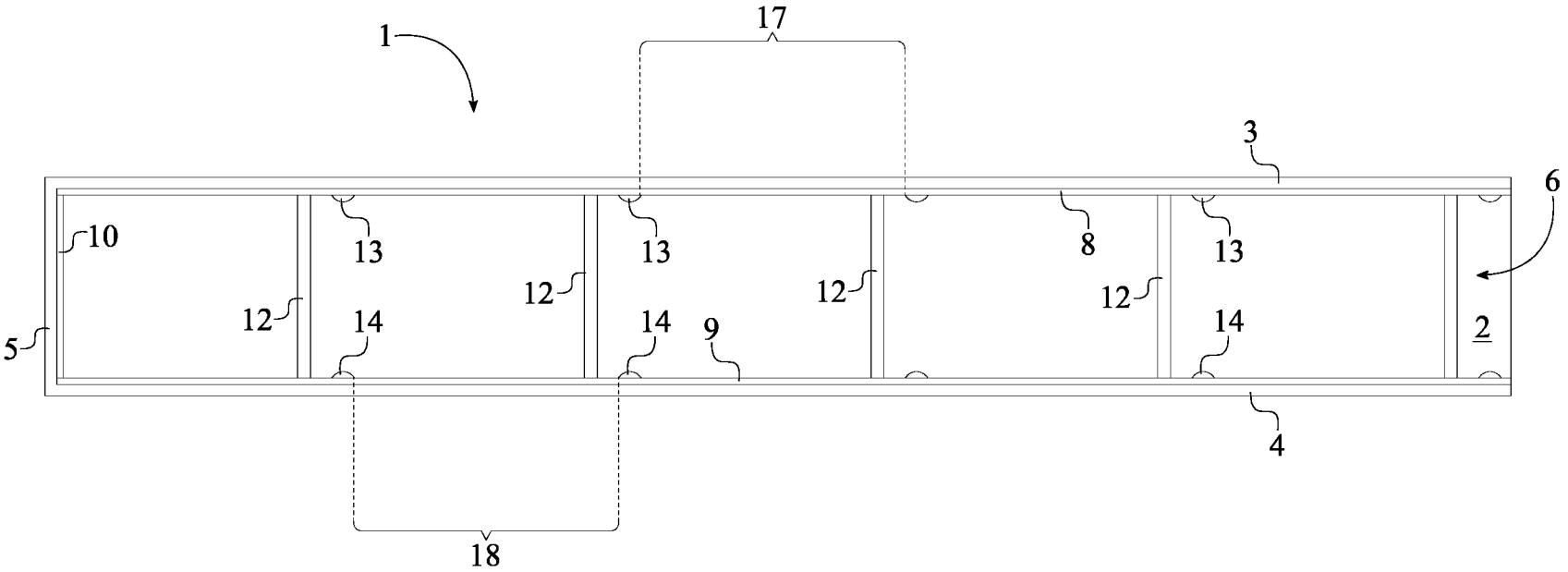
FIG. 4 is a top view of the present invention, without the roof, showing the first distance between the plurality of first spring loaded bodies, and the second distance between the plurality of second spring loaded bodies.

In second embodiment of the present invention, the wheelchair stopper 11 comprises a plurality of first spring loaded bodies 13 and a plurality of second spring loaded bodies 14 as shown in FIG. 1 and FIG. 4. The plurality of first spring loaded bodies 13 is retractably mounted along the first wall 3 and equally distributed along the first wall 3. The plurality of second spring loaded bodies 14 is retractably mounted along the second wall 4 and equally distributed along the second wall 4. Resultantly, an arbitrary body of the plurality of first spring loaded bodies 13 is oppositely positioned to a corresponding body of the plurality of second spring loaded bodies 14 so that a single wheelchair can be prevented from rolling back towards the entrance 6. More specifically, the plurality of first spring loaded bodies 13 and the plurality of second spring loaded bodies 14 are curve bodies and respectively retracted inward towards the first wall 3 and the second wall 4 as the rear wheels of a wheelchair smoothly glides over pushes them inward. Once the rear wheels of the wheelchair passes the plurality of first spring loaded bodies 13 and the plurality of second spring loaded bodies 14, the spring constant of the plurality of first spring loaded bodies 13 and the plurality of second spring loaded bodies 14 pushes them back into the natural position. A first distance 17 between an arbitrary body of the plurality of first spring loaded bodies 13 to a subsequent body of the plurality of first spring loaded bodies 13 ranges from 30-48 inches. Similarly, a second distance 18 between an arbitrary body of the plurality of second spring loaded bodies 14 to a subsequent body of the plurality of second spring loaded bodies 14 ranges from 30-48 inches. For example, the first distance 17 between a first body and a second body of the plurality of first spring loaded bodies 13 ranges from 30-48 inches while the second distance 18 between a first body and a second body of the plurality of second spring loaded bodies 14 also ranges from 30-48 inches thus storing a wheelchair. The stored wheelchair is then able to remain within specific storage area as the rear wheels of the stored wheelchair comes into contact with the second body of the plurality of first spring loaded bodies 13 and the second body of the plurality of second spring loaded bodies 14.

Optionally, the plurality of first spring loaded bodies 13 and the plurality of second spring loaded bodies 14 can be electrically connected to a power source through a control module. Furthermore, the plurality of first spring loaded bodies 13 and the plurality of second spring loaded bodies 14 are operated through a user interface that is also electrically connected to the power source. Resultantly, the user interface allows the users of the present invention to electronically operate the plurality of first spring loaded bodies 13 and the plurality of second spring loaded bodies 14 so that the wheelchairs can be easily move in and out of the floor mounted enclosure 1.

In third embodiment of the present invention, the wheelchair stopper 11 can comprise the plurality of first spring loaded bodies 13, the plurality of second spring loaded bodies 14, and the plurality of cross bumpers 12. Similar to the first embodiment and the second embodiment of the present invention, functionality and configuration of the corresponding wheelchair stopper 11 stays constant within the third embodiment of the present invention. However, the third embodiment of the present invention is able to incorporate two different ways to contain a wheelchair within the select storage space.

Figure 6:
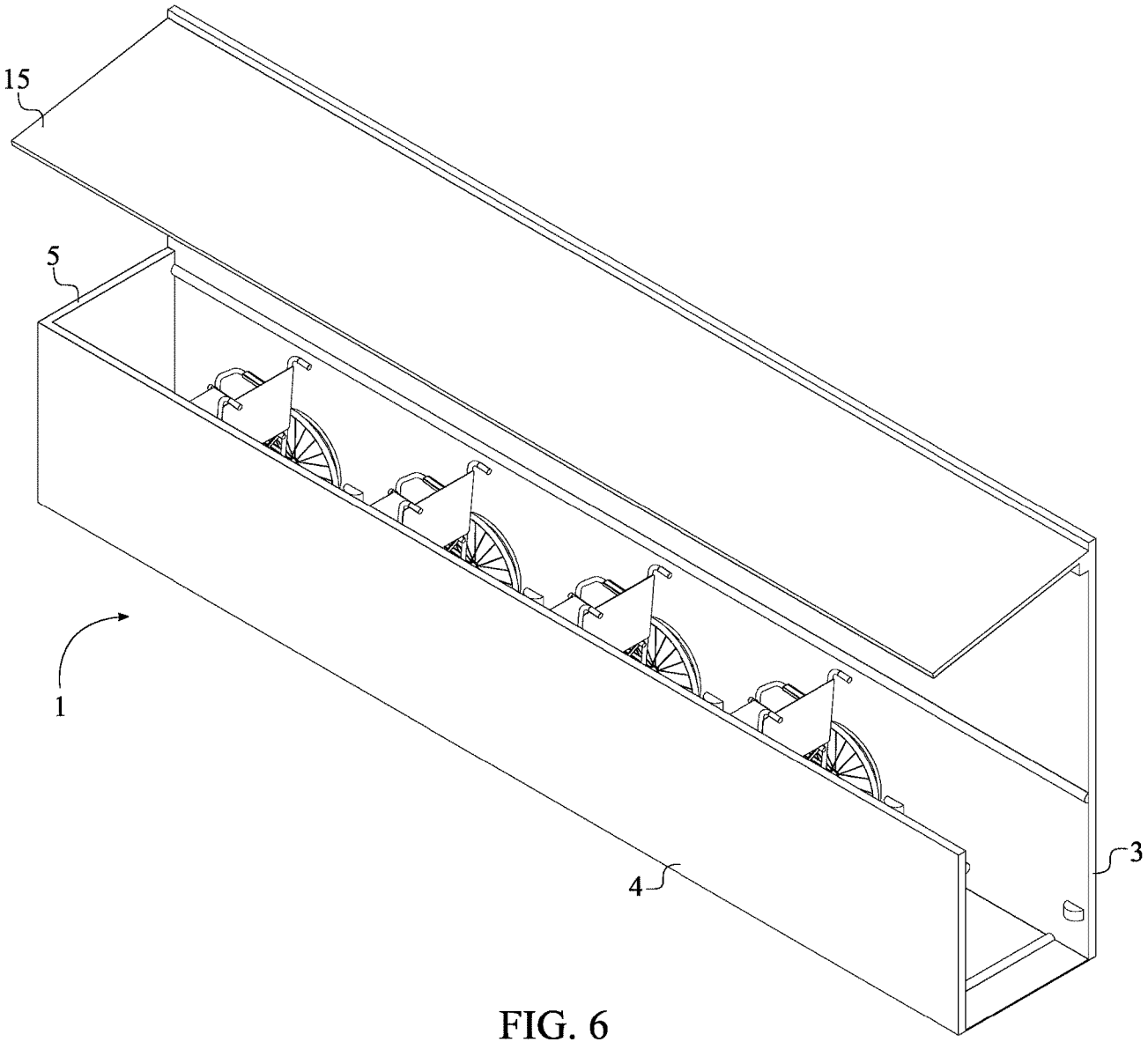
FIG. 6 is a top perspective view of the present invention, wherein the roof is mounted to the first wall.
Figure 7:
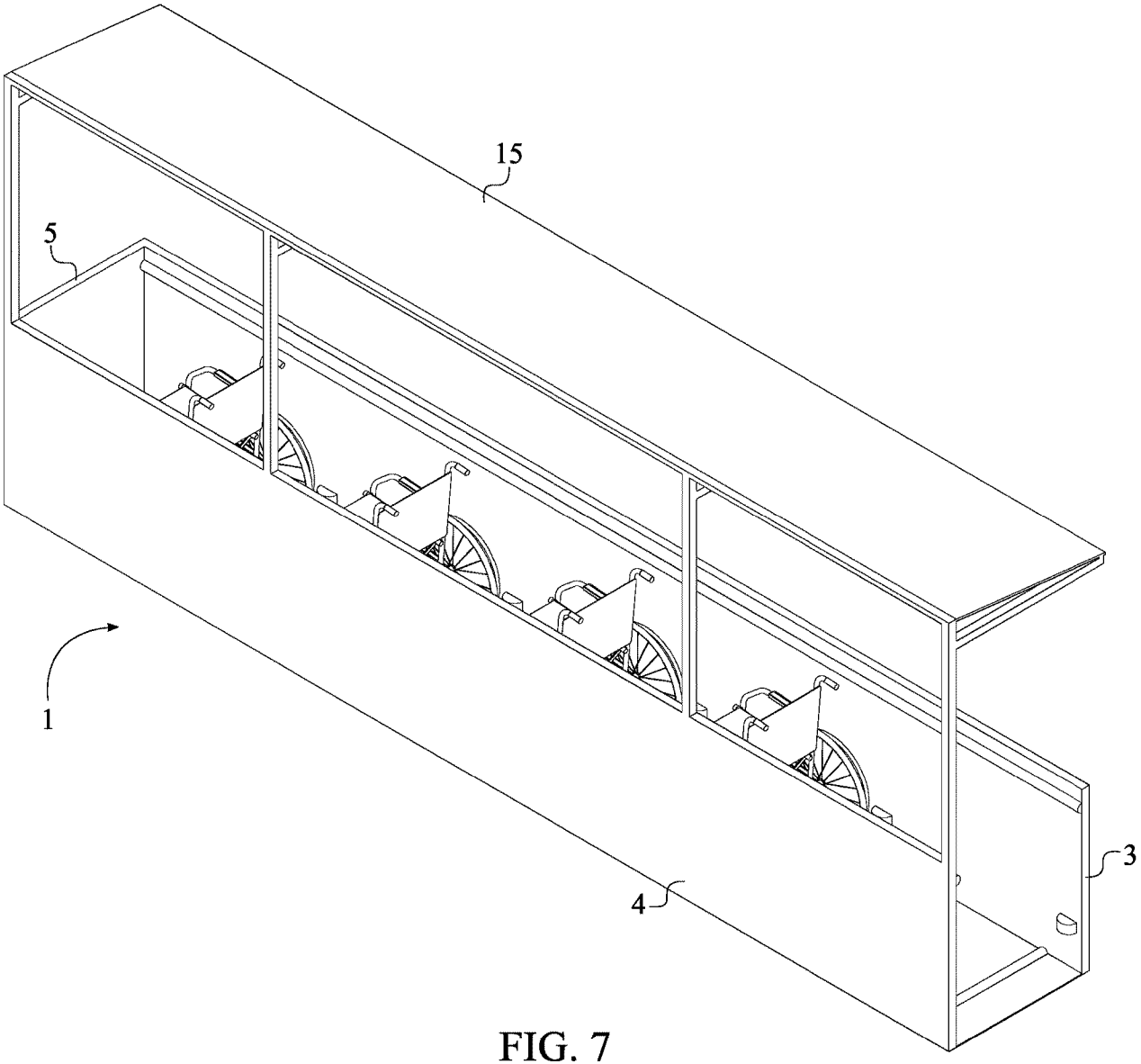
FIG. 7 is a top perspective view of the present invention, wherein the roof is mounted to the second wall.
Figure 8:
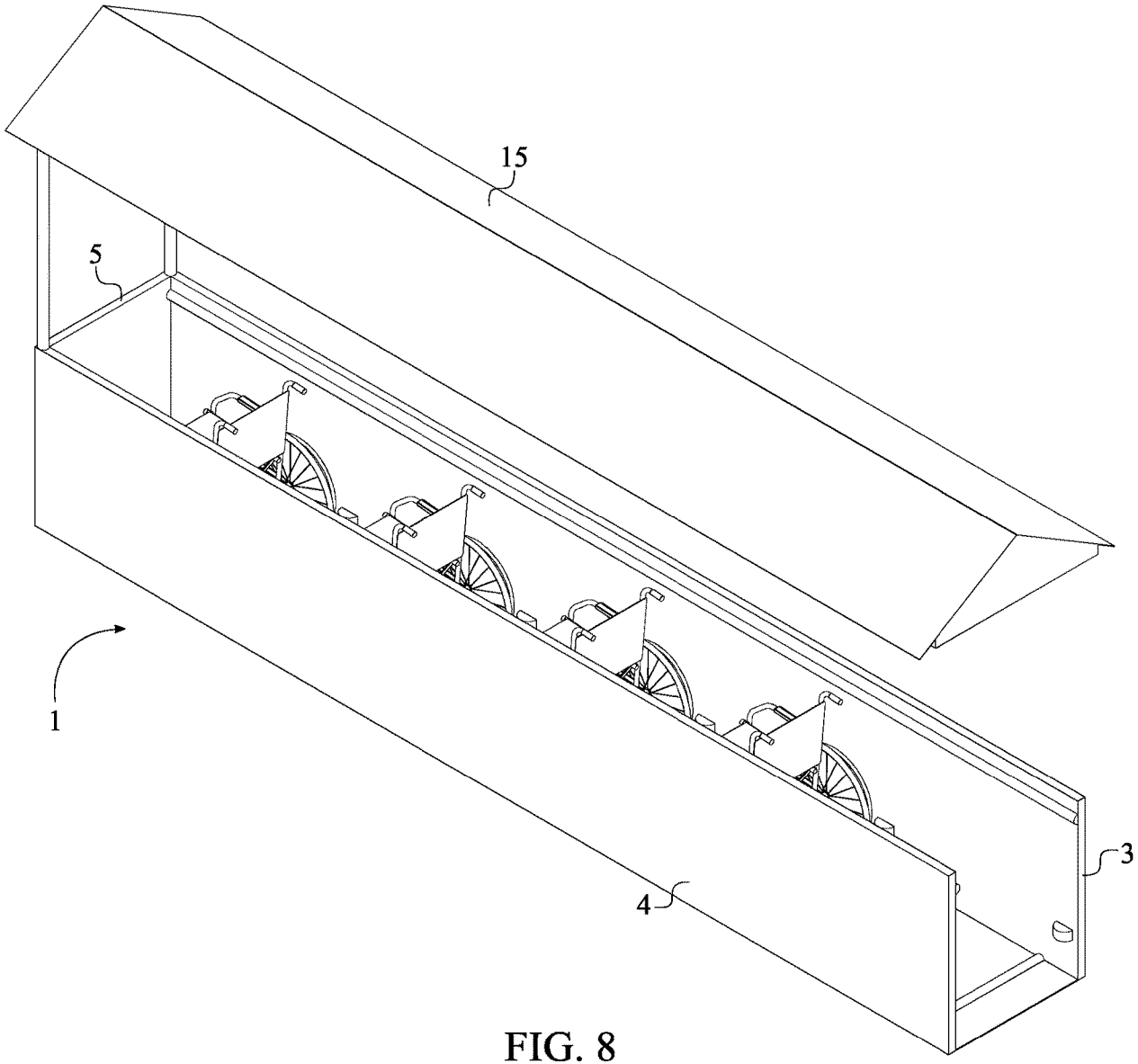
FIG. 8 is a top perspective view of the present invention, wherein the roof is mounted to the third wall.

In reference to FIG. 6-8, the present invention further comprises a cover 15 that is mounted to the floor mounted enclosure 1. The cover 15 that functions as a roof is integrated into the present invention so that the base floor 2 can be perimetrically enclosed by the cover 15. As a result, the cover 15 is able to protect the stored wheelchairs and any users within the enclosure 1 from outside elements. Furthermore, the cover 15 can be mounted to the first wall 3, the second wall 4, and/or the third wall 5 depending upon the structural configuration of the building.

Optionally, the present invention can further comprise an external power outlet to power any kind of electrical apparatus such as a sign, an illuminating system, a charging station, or any types of apparatus that are related to the present invention.

Although the invention has been explained in relation to its preferred embodiment, it is to be understood that many other possible modifications and variations can be made without departing from the spirit and scope of the invention as hereinafter claimed.

What is claimed is:

1. A stationary wheelchair storage apparatus comprising:

a floor mounted enclosure;

an entrance;

at least one guard rail;

a wheelchair stopper;

the floor mounted enclosure comprising a base floor, a first wall, a second wall, and a third wall;

the first wall, the second wall, and the third wall being perpendicularly mounted onto the base floor;

the third wall being terminally positioned to the first wall and the second wall;

the third wall being perpendicularly connected to the first wall and the second wall;

the entrance being delineated by the first wall and the second wall;

the at least one guard rail internally connected to the floor mounted enclosure;

the wheelchair stopper being integrated into the enclosure;

the wheelchair stopper comprising a plurality of first spring-loaded bodies and a plurality of second spring-loaded bodies;

the plurality of first spring-loaded bodies being retractably mounted along the first wall;

the plurality of first spring-loaded bodies being equally distributed along the first wall;

the plurality of second spring-loaded bodies being retractably mounted along the second wall; and the plurality of second spring-loaded bodies being equally distributed along the second wall.

2. The stationary wheelchair storage apparatus as claimed in claim 1 comprising:

the at least one guard rail comprising a first guard rail and a second guard rail;

the first guard rail being connected along the first wall;

the first guard rail being positioned offset of the base floor;

the second guard rail being connected along the second wall; and the second guard rail being positioned offset of the base floor.

3. The stationary wheelchair storage apparatus as claimed in claim 2 comprising:

the at least one guard rail comprising a third guard rail;

the third guard rail being connected along the third wall; and the third guard rail being positioned offset of the base floor.

4. The stationary wheelchair storage apparatus as claimed in claim 1 comprising:

wherein the wheelchair stopper being a plurality of cross bumpers;

each of the plurality of cross bumpers being equally distributed across the base floor;

each of the plurality of cross bumpers being perpendicularly positioned in between the first wall and the second wall; and each of the plurality of cross bumpers being mounted to the base floor.

5. The stationary wheelchair storage apparatus as claimed in claim 4, wherein a distance between each of the plurality of cross bumpers ranges from 30-48 inches.

6. The stationary wheelchair storage apparatus as claimed in claim 1, wherein an arbitrary body of the plurality of first spring-loaded bodies is oppositely positioned to a corresponding body of the plurality of second spring-loaded bodies.

7. The stationary wheelchair storage apparatus as claimed in claim 1 comprising:

a first distance between an arbitrary body of the plurality of first spring-loaded bodies to a subsequent body of the plurality of first spring-loaded bodies ranges from 30-48 inches; and a second distance between an arbitrary body of the plurality of second spring-loaded bodies to a subsequent body of the plurality of second spring-loaded bodies ranges from 30-48 inches.

8. The stationary wheelchair storage apparatus as claimed in claim 1 comprising:

a cover;

the cover being mounted to the floor mounted enclosure; and the base floor being perimetrically enclosed by the cover.

9. The stationary wheelchair storage apparatus as claimed in claim 8, wherein the cover is mounted to the first wall.

10. The stationary wheelchair storage apparatus as claimed in claim 8, wherein the cover is mounted to the second wall.

11. The stationary wheelchair storage apparatus as claimed in claim 8, wherein the cover is mounted to the third wall.

* * * * *